US012350600B1

(12) United States Patent
Hartle

(10) Patent No.: US 12,350,600 B1
(45) Date of Patent: Jul. 8, 2025

(54) SWING SET ASSISTANT

(71) Applicant: Wayne Hartle, Murray, UT (US)

(72) Inventor: Wayne Hartle, Murray, UT (US)

( * ) Notice: Subject to any disclaimer, the term of this patent is extended or adjusted under 35 U.S.C. 154(b) by 0 days.

(21) Appl. No.: 18/958,084

(22) Filed: Nov. 25, 2024

(51) Int. Cl.
*A63G 9/14* (2006.01)
*A63G 9/12* (2006.01)

(52) U.S. Cl.
CPC ..... *A63G 9/14* (2013.01); *A63G 9/12* (2013.01)

(58) Field of Classification Search
CPC ... A63G 9/00; A63G 9/02; A63G 9/04; A63G 9/06; A63G 9/10; A63G 9/12; A63G 9/14; A63G 9/16; A63G 9/18; A63G 9/20; A63G 9/22; A63G 13/02; A63G 13/04; A47D 13/10
See application file for complete search history.

(56) References Cited

U.S. PATENT DOCUMENTS 1,579,136 A * 3/1926 Paxson ..... A63G 9/12 248/343
4,493,373 A * 1/1985 Jackson ..... F16J 15/166 277/584
5,624,321 A * 4/1997 Snyder ..... A63G 9/14 472/135
8,672,770 B2 * 3/2014 Matt ..... A63G 9/14 472/135
9,789,409 B1 * 10/2017 Yakos ..... A63G 9/12
11,090,570 B1 * 8/2021 Hsiang ..... A63G 9/02
2022/0047955 A1 * 2/2022 Wang ..... A63G 9/16

* cited by examiner

*Primary Examiner* — Michael D Dennis

(57) ABSTRACT

A swing set assistance kit includes a flexible cantilever member such as a helical spring, with its first end attachable to a base which is a plate or a bracket with a first stud. A transverse bar has a second stud at its mid-section and its ends affixed at intermediate points of the lines attaching the swing seat to an overhead beam of the swing set. An alternative embodiment directed to swing seats such as a tire or other arbitrary seat shapes has seat lines attaching the seat to a seat plate that has the second stud for attachment to the flexible member. The flexible cantilever member and its attachment points to the other swinging components alters the effective length of the pendulum of the system, which may be used to alter the natural period of the system, allowing a user to achieve large amplitude, enjoyable swinging more quickly.

14 Claims, 5 Drawing Sheets

SWING SET ASSISTANT

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

FIELD

The invention relates to improvements for playground swings and recreational swings.

BACKGROUND

Swinging is a recreational act applying pendulum physics to enjoy feelings of weightlessness or near weightlessness at the ends of a swinging arc, moving at high speed at the bottom of the arc, and enjoying the surrounding sights from high elevations at the ends of the swinging arc. The greatest and most enjoyable effects occur when the user achieves the largest possible swing arc that the swing set can provide.

A swing is essentially a pendulum system for simple harmonic motion. Starting from rest at a nadir, a user of a swing set grasps the lines which connect the seat to an overhead beam, and by a succession of "pumping" actions of the user's limbs, the user adds energy to the system which is exchanged between high rotational kinetic energy (and speed) at the nadir and high gravitational potential energies at the ends of the swing arc.

Starting up the pendulum swing motion primarily involves timing the extensions and flexions of the users limbs to alter the rotational moment of inertia of the system and may also include weight shifting and leaning in the seat so that the lines also bend at the points where the user is grasping the lines, thereby converting the system from a first order pendulum to a second order pendulum having a slightly different cyclic frequency (or period) of the system.

What may be desirable for some users less able to generate the optimum system energy inputs or to time these inputs for maximum accelerations and maximum excursions of the system (amplitude) would be to add new and clever components to the system that facilitate or increase the available options for storage and transfer of system rotational kinetic energy, including new and clever alternatives for system potential energy storage other than gravitational potentials.

BRIEF DESCRIPTION

A primary objective of the invention is to provide a swingset including new and clever components to the system that facilitate or increase the available options for storage and transfer of system rotational kinetic energy, including new and clever alternatives for system potential energy storage other than gravitational potentials.

Another objective of the invention is to enable users of a swing set to more rapidly or more easily increase the system oscillation amplitude and reduce the start-up time and energy expenditures building up to a most desired large oscillation state.

A corollary objective of the invention is to enable a user of a swing set to more rapidly achieve extreme system amplitudes and the corresponding enjoyment of the surrounding sights from high elevations, and other corollary objectives of the invention are to afford a swing set user more time at these amplitude end points, and more time experiencing the thrill of at or near weightlessness while far above the ground.

BRIEF DESCRIPTION OF THE DRAWINGS

A further understanding of the nature and advantages of particular embodiments may be realized by reference to the remaining portions of the specification and the drawings, in which like reference numerals are used to refer to similar components. When reference is made to a reference numeral without specification to an existing sub-label, it is intended to refer to all such multiple similar components.

DETAILED DESCRIPTION OF CERTAIN EMBODIMENTS

Figure 1:
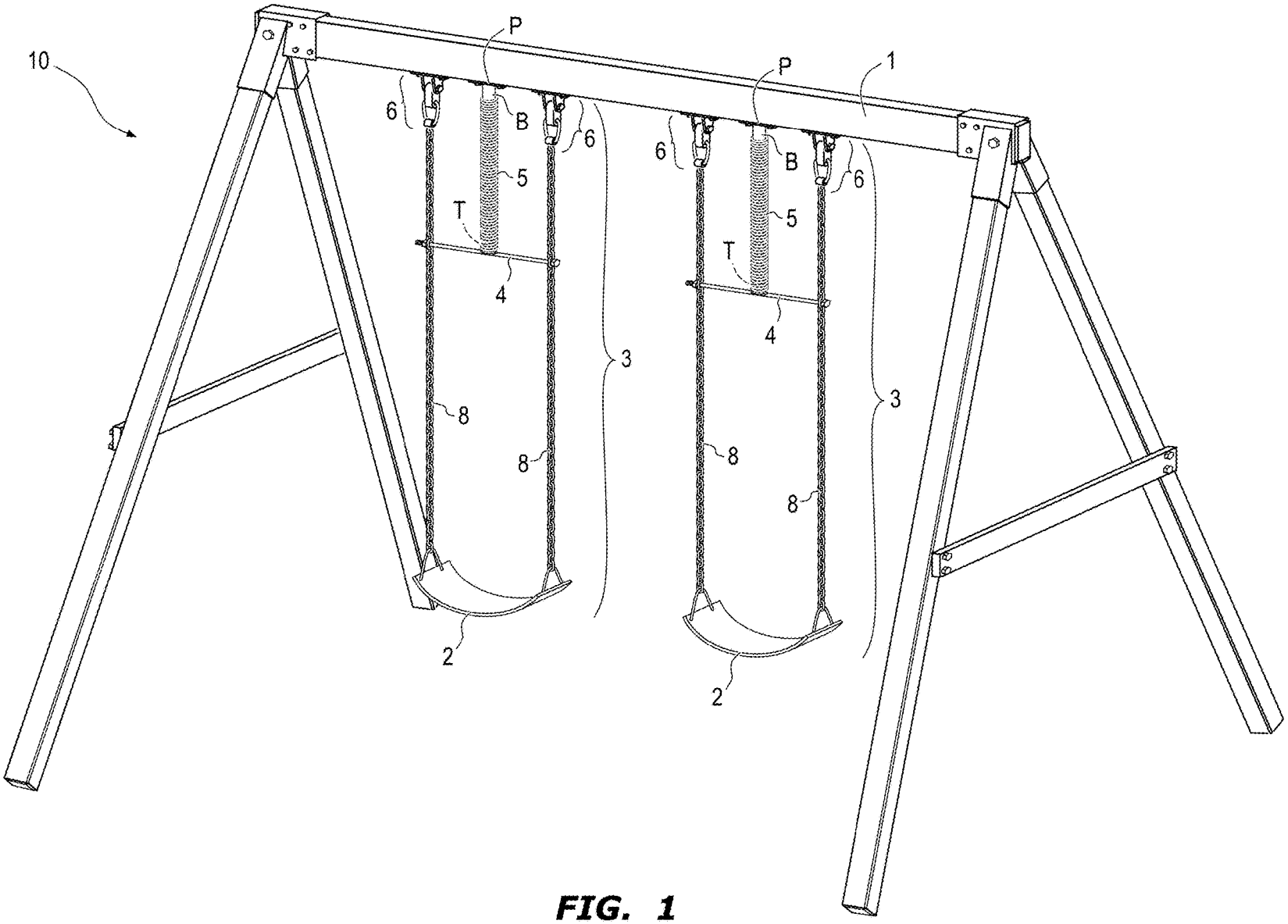
FIG. 1 shows an oblique view of one from a plethora of possible embodiments of the invention wherein the example depicted shows two swing seat assemblies in accordance with the invention.

While various aspects and features of certain embodiments have been summarized above, the following detailed description illustrates a few exemplary embodiments in further detail to enable one skilled in the art to practice such embodiments. The described examples are provided for illustrative purposes and are not intended to limit the scope of the invention.

In the following description, for the purposes of explanation, numerous specific details are set forth in order to provide a thorough understanding of the described embodiments. It will be apparent to one skilled in the art, however, that other embodiments of the present invention may be practiced without some of these specific details. Several embodiments are described herein, and while various features are ascribed to different embodiments, it should be appreciated that the features described with respect to one embodiment may be incorporated with other embodiments as well. By the same token, however, no single feature or features of any described embodiment should be considered essential to every embodiment of the invention, as other embodiments of the invention may omit such features.

In this application the use of the singular includes the plural unless specifically stated otherwise, and use of the terms "and" and "or" is equivalent to "and/or," also referred to as "non-exclusive or" unless otherwise indicated. Moreover, the use of the term "including," as well as other forms, such as "includes" and "included," should be considered non-exclusive. Also, terms such as "element" or "component" encompass both elements and components comprising one unit and elements and components that comprise more than one unit, unless specifically stated otherwise. Where grammatical genders are concerned, a "user" of the invention may be of any gender regardless of any specific pronouns or grammar used in this specification. Thus, masculine grammatical forms may be interpreted to include and subsume feminine or any other grammatical genders.

Where figures depict a user, any resemblance to actual persons or copyrighted characters is entirely coincidental and irrelevant to the material being disclosed and explained. Also, regardless of appearances as depicted, a user may be of any gender or physique and the specificities of the artworks presented herein are in no way intended to exclude or limit any range or types of persons who may enjoy the benefits of the invention.

Describing how to swing on a swing set is a matter approachable from a mastery of US high school physics if not secondary school physics. Starting from an initial rest position at the bottom of the arc, a user of a swing set usually seeks to increase the amplitude of the swinging motion as quickly as possible. For young children using a swing, an older and larger family member or friend may be enlisted to push the child intermittently to add energy to the pendulum system comprising the child, the swing seat, and the lines which connect from an overhead beam to the swing seat.

A swing set user may also "pump" the pendulum system by alternately extending and flexing his or her limbs to change the moment of inertia of the human body moving in its arc centered about the overhead beam. Once sufficient swinging amplitude is achieved, a swing set user may sustain or increase the swinging amplitude by timing when to flex and extend limbs to add or remove physical work to and from the system in pulses while changing the rotational inertia of the system. Increasing the rotational inertia of the system slows down the swinging.

Energy may also be removed from the system by coasting and allowing frictional losses and air drag to slow the system down. The user may also dissipate system energy by dragging feet while passing close to the ground. Speeding up the swinging motion of the system may be effected not only by decreasing rotational inertia such as by flexing or extending limbs, but also by reducing the natural period of the system as discussed further below.

The invention is a swing set assistance kit which includes a flexible cantilever member such as a helical spring, with its first end attachable to a base which is a plate or a bracket with a first stud. A transverse bar has a second stud at its mid-section and its ends affixed intermediate points of the lines attaching the swing seat to an overhead beam of the swing set. An alternative embodiment directed to swing seats such as a tire or other arbitrary seat objects has seat lines attaching the seat to a seat plate that has the second stud for attachment to the flexible member. The flexible cantilever and its attachment points to the other swinging components alters the effective length of the pendulum of the system, which may be used to alter the natural period of the system, allowing a user to achieve large amplitude, enjoyable swinging more quickly.

Referring now to the figures, FIG. 1 shows an oblique view of one embodiment [10] from among a plethora of possible embodiments of the invention wherein the example depicted shows two swing seat assemblies in accordance with the invention. A swing set typically includes an overhead beam [1] and at least one swing seat assembly [3] that includes a swing seat [2] having first and second ends, and seat lines [8] of which a first seat line extends from the first swing seat end to the overhead beam, and a second seat line extends from the second swing seat end to the overhead beam.

A swing set assistance system in accordance with the invention may be packaged and sold as a kit to be installed on existing swing sets, or a swing set manufacturer may include the components as a subassembly of of a swing set comprising the novel components. Thus a swing set assembly incorporating components of the assistance kit is in itself another type of embodiment within the scope of the invention.

The novel components include a flexible cantilever member [5] having first and second ends, a base [P] further comprising a first stud [B,] a transverse bar [4] having first and second ends and a mid-section, with a second stud [T] affixed to this mid-section. The first stud is attachable to the first end of the flexible cantilever member and the second stud is attachable to the second end of the flexible cantilever member. One end, such as the first end of the transverse bar is attached to the first seat line at a first intermediate point on the first seat line. The other, or second end of the transverse bar is attached to the second seat line at a first intermediate point on the second seat line. The seat lines attach to the overhead beam at an attachment fixture [6] such as a bracket, clamp or hinge allowing the connection to act at least as a pin joint. The seat lines typically pivot about an axis parallel or coaxial to the longitudinal axis of the overhead beam, but this hardware may also allow other unconstrained degrees of freedom such as for multi-axial pivoting and may also allow swiveling of the seat line with respect to this attachment point.

Figure 2:
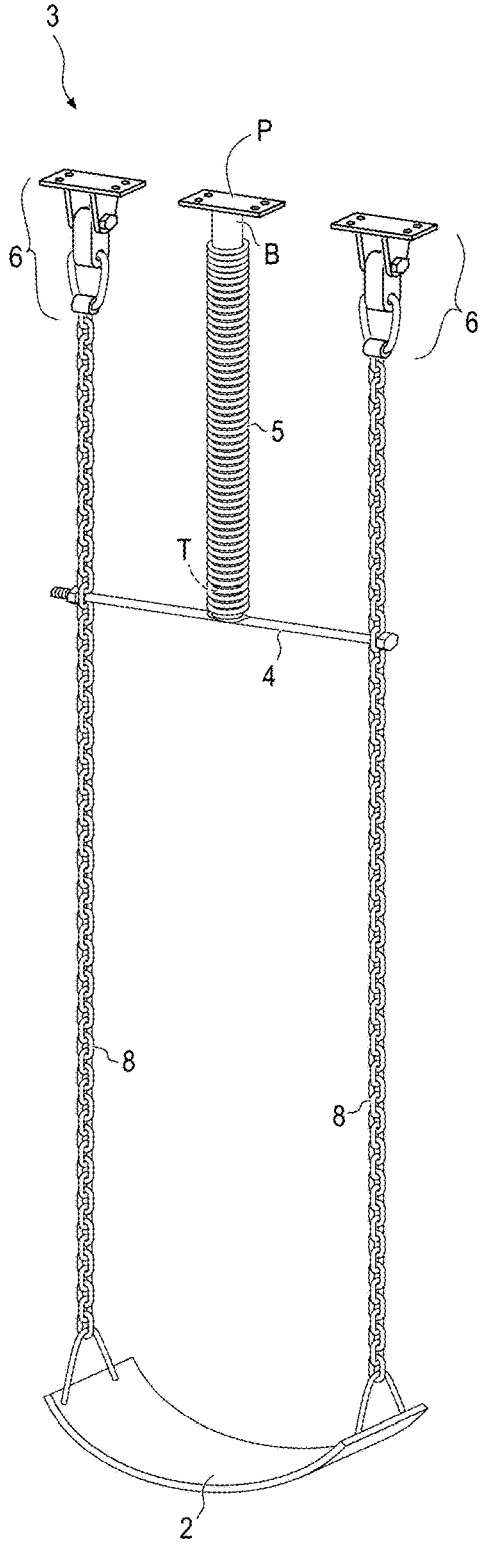
FIG. 2 shows components of one of the inventive swing seat assemblies seen in FIG. 1 which includes a swing set assistance kit.

FIG. 2 shows components of one of the inventive swing seat assemblies [3] seen in FIG. 1 which includes a swing set assistance kit in accordance with the invention. The swing set assistance kit includes a flexible cantilever member [5] having first and second ends and a base [P] that includes a first stud [B.]A transverse bar [4] has a length and a mid-section of its length, and a second stud [T] affixed to this mid-section.

When the kit parts are assembled to a swing set seat assembly, the first stud attaches to the first end of the flexible cantilever member and the second stud attaches to the second end of the flexible cantilever member. The first end of the flexible cantilever member has an attachment point or means, such as a cavity into which at least a portion of the first stud may be received. The second end of the flexible cantilever member also has an attachment point or means, such as a cavity into which at least a portion of the second stud may be received.

A preferable embodiment of a flexible cantilever member may be or may include a helical spring. The spring coil forms a lumen which acts as a cavity at the ends of the spring. The studs are or include cylinders which are closely sized to the inner lumen of the coil spring. Local clamping hardware affixes the last few coils at the ends of spring to the studs. The studs may be formed to receive and cooperate with the coil ends like internal and external mechanical threads. The flexible cantilever member may also be secured to the stud by welding, brazing, solder, adhesive, or one or more external clamps such as hose clamps or snap rings. The seat [2] includes seat lines [8] at its ends which attach to pivotable hardware [6] such as a swivel bracket. These brackets for the seat lines and the base [P] or plate for the first stud all attach to the overhead beam of a frame for the swing set assembly.

Although it is possible to use the invention in less preferred modes where the length from the overhead beam to the first intermediate point on the first seat line is substantially different from the length from the overhead beam to the first intermediate point on the second seat line, this would set the transverse bar at an orientation other than substantially horizontal. In preferable uses the length from the overhead beam to the first intermediate point on the first seat line is within about 35% of a second distance from the overhead beam to said first intermediate point on the second seat line.

Figure 3A:
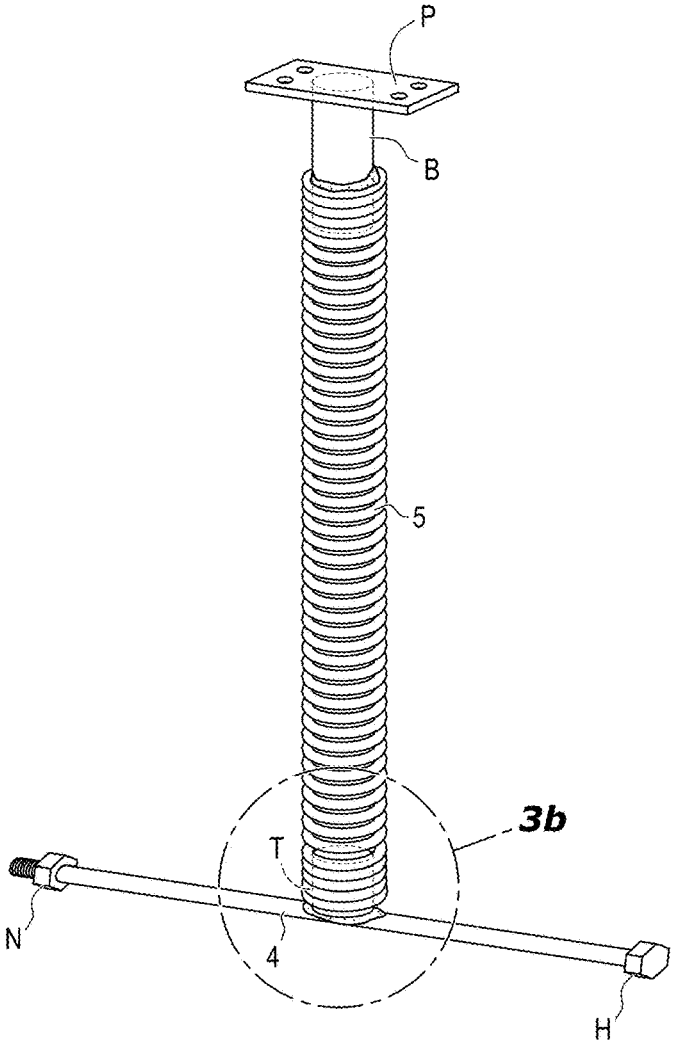
FIG. 3*a* shows components of a swing set assistance kit in accordance with the invention and defines a detail region for detail view FIG. 3*b*.
Figure 3B:
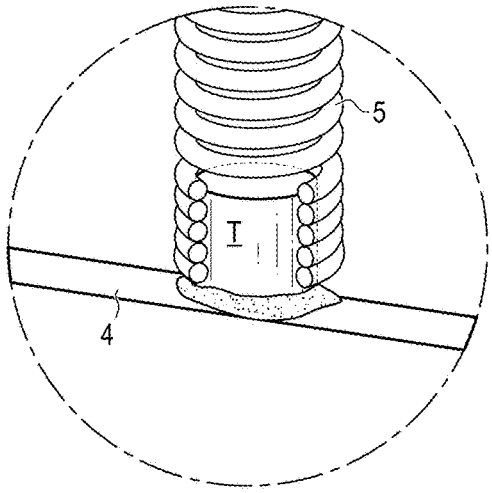
FIG. 3*b* shows an enlargement of a portion of the swing set assistance kit of FIG. 3*a* where a transverse bar is joined to a lower end of a flexible cantilever member.

FIG. 3*a* shows components of a swing set assistance kit in accordance with the invention and defines a detail region for detail view FIG. 3*b*. The set of components shown in this figure may be sold as a kit to be installed onto an existing swing set so as to provide the benefits of the invention. A swing set assistance kit in accordance with the invention includes a flexible cantilever [5] member having first and second ends, a base [P] having a first stud [B,] and a transverse bar [4] having first and second ends and a mid-section. A second stud [T] is affixed to the mid-section, and the first stud is attachable to the first end of the flexible cantilever member and the second stud is attachable to the second end of the flexible cantilever member.

The first end of the flexible cantilever member includes a cavity into which at least a portion of the first stud may be received, and the second end of the flexible cantilever member also includes a cavity into which at least a portion of the second stud may be received. In preferable embodiments the flexible cantilever member may include a helical spring or may include a solid or hollow beam of an elastic material. If the elastic material is formed as a tube with a lumen throughout, then the ends of the lumen act as end cavities for receiving the first and second studs.

In other aspects of preferable embodiments within the scope of the invention, at least one end from among the first and second ends of the transverse bar comprises a threaded feature. In the example shown, the transverse bar is a long bolt with a threaded end, convenient for swing seat lines made of chain. The body or shank of the rod is of a first diameter small enough to pass through an aperture in a link of chain of one of the seat lines, and at least one end from among the first and second ends of the transverse bar includes a head [H] having a second diameter larger than the first diameter and also larger than the aperture in the chain link. The other end of the rod is includes a threaded feature, so that a nut (which may be seen as a component of the kit) having threads complementary to the threaded feature may be installed after passing the second end of the rod through a corresponding link in the other seat line. In this arrangement the nut and bolt head couple to the seat lines so that a length of each line commensurate with the length of the flexible cantilever member all deflect in concert.

FIG. 3*b* shows an enlargement of a portion of the swing set assistance kit of FIG. 3*a* where a transverse bar is joined to a lower end of a flexible cantilever member. The second end of the flexible cantilever member [5] has a cavity into which at least a portion of the second stud [T] is received. The coils of the spring are broken out to show the second stud inserted into the cavity of the flexible cantilever member. The second stud is affixed to a mid-section of the transverse bar [4.] The flexible cantilever member in this example is or at least includes a helical spring.

Figure 4:
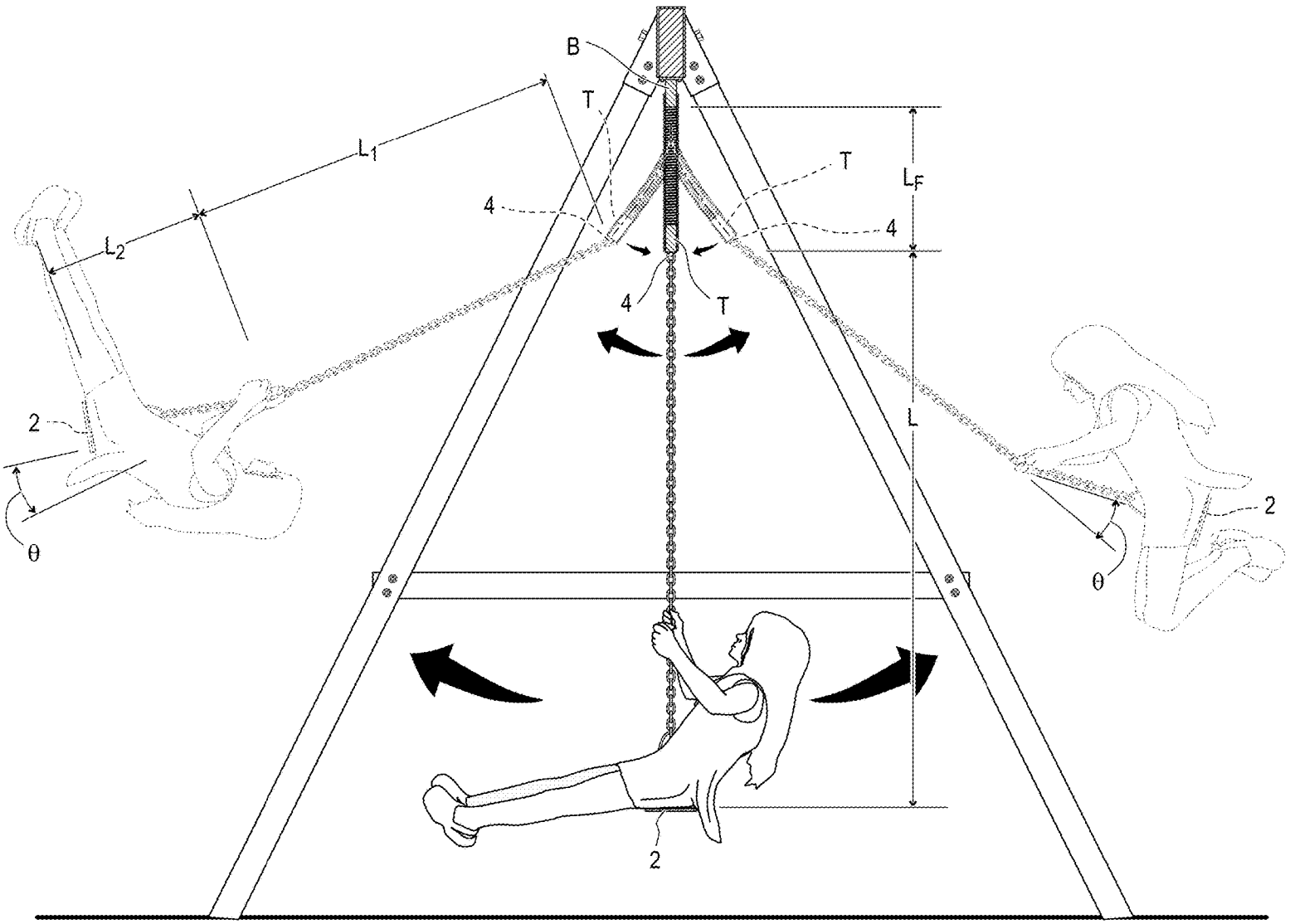
FIG. 4 shows a user of a swing set equipped with a swing set assistance kit in accordance with the invention.

FIG. 4 shows a user of a swing set equipped with a swing set assistance kit in accordance with the invention. A swing set having an overhead beam and at least one swing seat assembly further includes a swing seat [2] having first and second ends. The seat extends perpendicular to the plane of this view, but the seat ends are seen in other FIGS. 1 and 2.

The swing set assistance system includes a flexible cantilever member having first and second ends, a base further comprising a first stud [B,] and a transverse bar (also extending perpendicular to the plane of this view) attached to the seat line at an intermediate point along its length. This intermediate point in this figure resides a distance [$L_F$] along the seat line taken from the attachment point on the underside of the overhead beam. The remaining free length of the seat line from this intermediate point is of a length [L.]

From grade-school physics the period [D] of a first-order pendulum is $$D = 2\pi\sqrt{\frac{L + L_F}{g}}$$

with the effective length of the pendulum as pertains to FIG. 4 being the sum $L+L_F$. The user shown in this figure is "pumping" the swing by retracting her legs at one end of the swinging arc when her speed (the angular velocity of the system,) is low or zero. While her legs are extended the mass of her legs will reside closer to the rotational center of the system, reducing rotational inertia of the system so she can accelerate faster under gravity and also swing faster through the nadir of the swinging arc. This is the same effect as when a spinning ballerina draws her arms in and spins faster.

The second way the user shown here "pumps" the swing system occurs at the ends of the swinging arc when she grabs the seat lines and leans in the direction of the swinging motion, breaking the length [L] of the seat line into two segments [$L_1$] and [$L_2$.] Now the system becomes a second-order pendulum, with a shorter period (a faster swing) than before, similar to shortening the seat lines. The invention introduces a second point of inflection at the end of the flexible cantilever member and a second seat of energy storage besides the mass of the user in a gravitational field: the energy stored and retrievable from the deflection of the flexible member. The effective length of the system is thus reduced further and the oscillation of the swing achieves higher velocities at the nadir and greater heights at the ends of the swinging arc.

Figure 5:
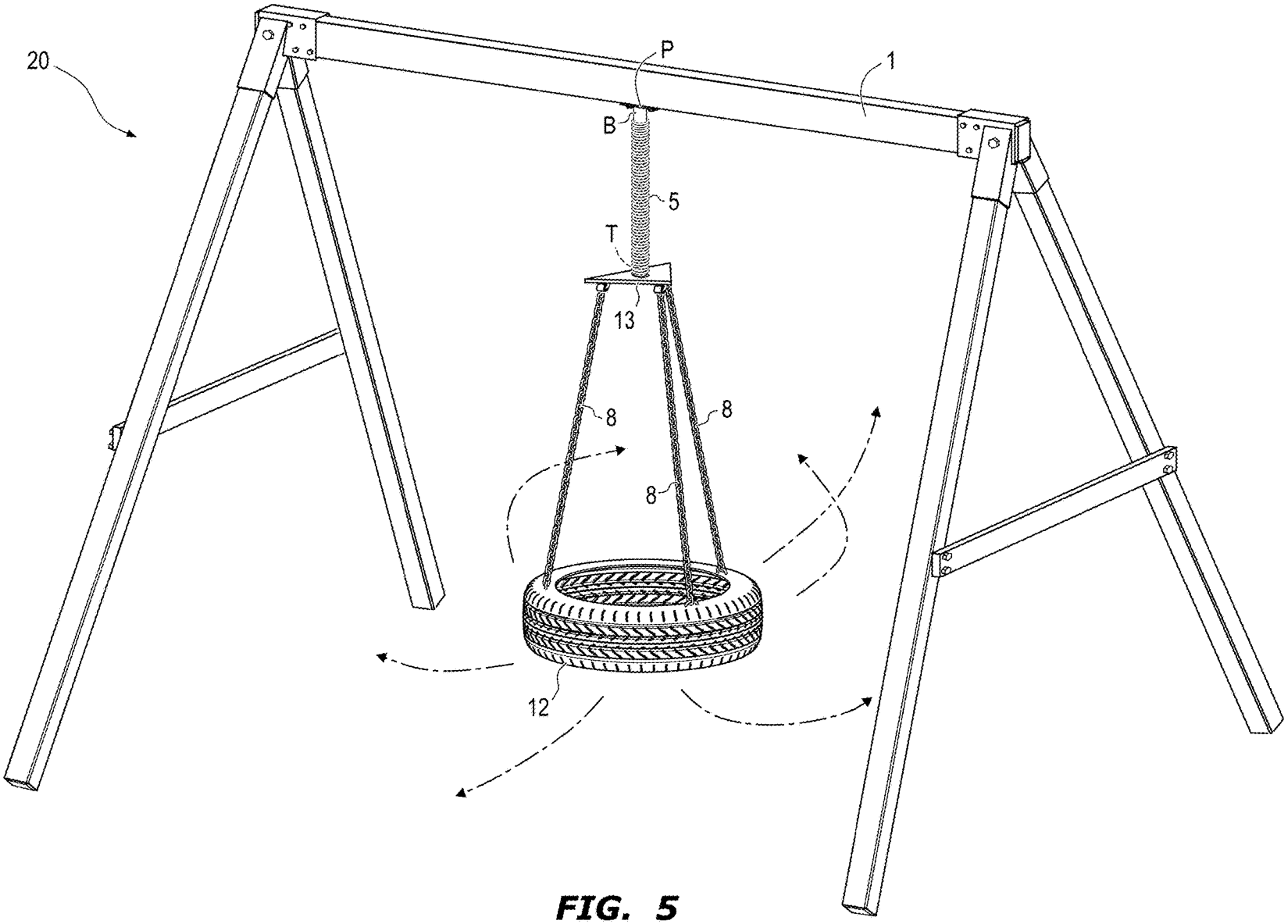
FIG. 5 shows an alternative embodiment of a swing set also equipped with an alternative embodiment of a swing set assistance kit in accordance with the invention.

FIG. 5 shows an alternative embodiment [20] of a swing set also equipped with an alternative embodiment of a swing set assistance kit in accordance with the invention. The swing set assistance kit shown here includes a flexible cantilever member [5] having first and second ends, a base [P] which attaches to the overhead beam [1] of the frame of the swing set. The base includes a first stud [B] and a seat plate [13] for attachment to a swing seat [12,] which may be a more arbitrary shape than a typical playground swing of FIG. 1. These other shapes may support spinning the seat while swinging. The seat plate has a second stud [T] affixed to it. The first stud is attached to the first end of the flexible cantilever member and the second stud is attached to the second end of the flexible cantilever member. The seat may have any number of seat lines [8] connecting it to the seat plate. In preferable embodiments the perimeter contour of the plate may include a polygon having a number of corners equal to the number of seat lines between it and the seat. The seat plate may be of a complementary shape for balancing the loads of the seat lines if the swing seat itself is an irregular object or if it invites more than one user to sit and swing on the apparatus.

Figure 6:
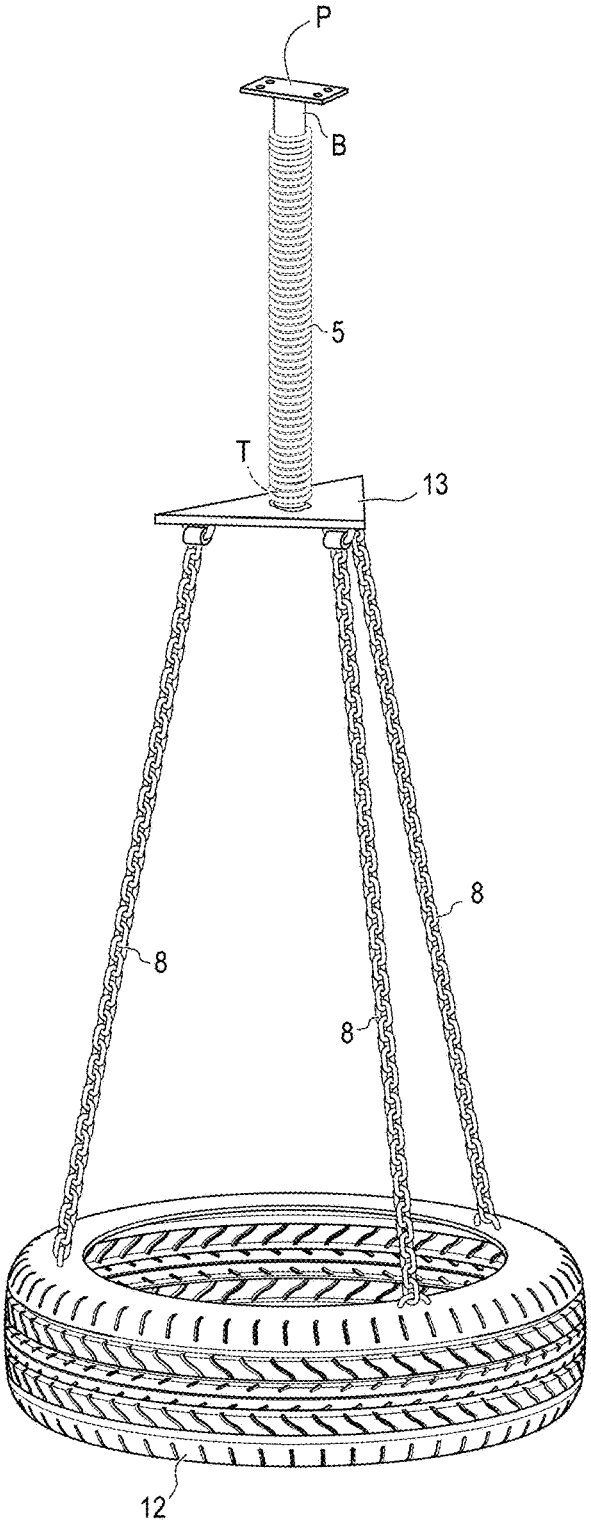
FIG. 6 shows components of the inventive swing seat assemblies seen in FIG. 5 which includes an alternative embodiment of a swing set assistance kit in accordance with the invention.

FIG. 6 shows components of the inventive swing seat assemblies seen in FIG. 5 which includes an alternative embodiment of a swing set assistance kit in accordance with the invention. The seat assembly shown includes components of a swing set assistance kit in accordance with the invention. The components include a flexible cantilever member [5] having first and second ends, a base [P] that includes a first stud [B,] and a seat plate [13] for attachment to a swing set seat [12] and having a second stud [T] attached to the plate. The first stud is attachable to the first end of the flexible cantilever member, and the second stud is attachable to the second end of the flexible cantilever member. The seat connects to the plate by one or more seat lines [8.] The base may be a plate or a bracket for securing the assembly to an overhead beam.

Figure 7A:
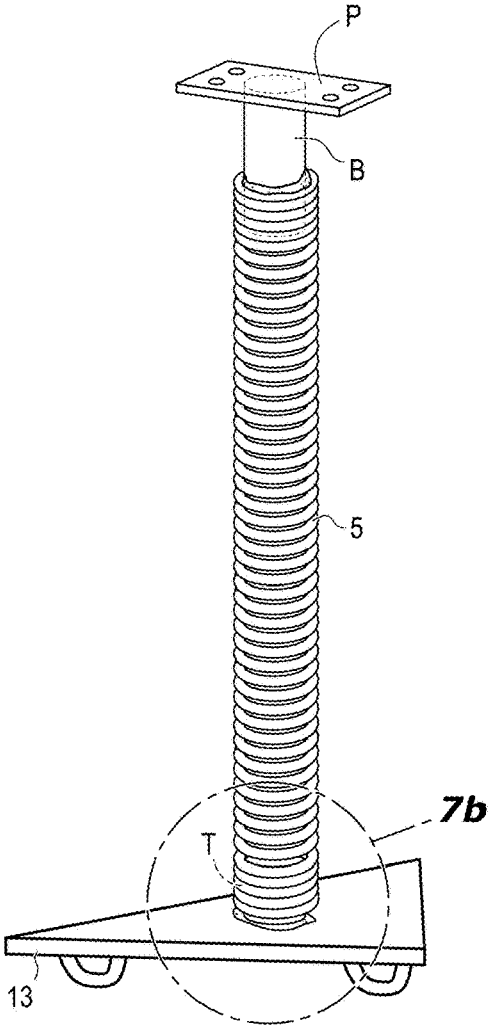
FIG. 7*a* shows the components of the alternative embodiment of the swing set assistance kit seen in FIG. 6 and defines a detail region for detail view FIG. 7*b*.
Figure 7B:
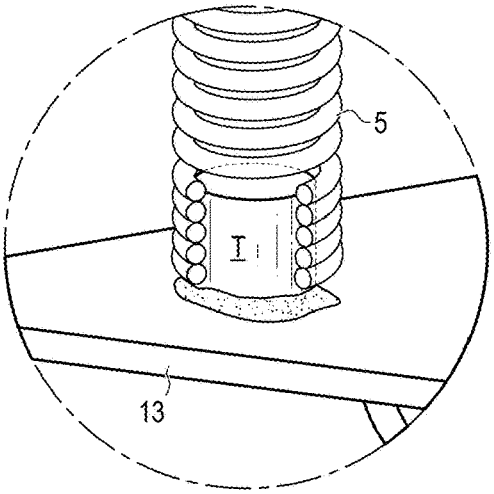
FIG. 7*b* shows an enlargement of a portion of the swing set assistance kit of FIG. 7*a* where a seat line plate is joined to a lower end of a flexible cantilever member.

FIG. 7*a* shows the components of the alternative embodiment of the swing set assistance kit seen in FIG. 6 and defines a detail region for detail view FIG. 7*b*. The first end of the flexible cantilever member [5] includes a cavity into which at least a portion of the first stud [B] is received. The second end of the flexible cantilever member also includes a cavity into which at least a portion of the second stud [T] is received. In preferable embodiments the flexible cantilever member may include a helical spring or may include a solid or hollow beam of an elastic material. If the elastic material is formed as a tube with a lumen throughout, then the ends of the lumen act as end cavities for receiving the first and second studs.

Embodiments of the type for which this is one example within the scope of the invention may include a seat of an arbitrary shape designed to support one or more than one user and may exert uniform or non-uniform loads channeled to the seat plate by a plurality of seat lines. This may include seats fashioned to resemble animals and seats designed for disparate weight distribution such as a parent-child configuration wherein some of the seat lines support the weight of a mature adult while others support a youth or a child. In the embodiment illustrated the seat is made from or is reminiscent of an automobile tire, and a plurality of seat lines converge and connect to the seat plate. In this embodiment shown, the seat plate has a perimeter that comprises a polygon, which may also be a polygon having rounded apices. The seat plate has a first side from which the second stud emerges and a second side opposite the first side having attachment affordances for the seat lines. These attachment sites may include eyes or eyelets, hasps, clevises, or u-bolts.

FIG. 7*b* shows an enlargement of a portion of the swing set assistance kit of FIG. 7*a* where a seat plate [13] is joined to a lower end of a flexible cantilever member [5.] The second end of the flexible cantilever member has a cavity into which at least a portion of the second stud [T] is received. The coils of the spring are shown broken out to show the second stud inserted into the cavity of the flexible cantilever member. The flexible cantilever member in this example is or at least includes a helical spring. The flexible cantilever member may also be secured to the stud by welding, brazing, solder, adhesive, or one or more external clamps such as hose clamps or snap rings.

While certain features and aspects have been described with respect to exemplary embodiments, one skilled in the art will recognize that numerous modifications are possible. Also, while certain functionality is ascribed to certain system components, unless the context dictates otherwise, this functionality may be distributed among various other system components in accordance with the several embodiments.

Moreover, while the procedures of the methods and processes described herein are described in a particular order for ease of description, unless the context dictates otherwise, various procedures may be reordered, added, and/or omitted in accordance with various embodiments. Furthermore, the procedures described with respect to one method or process may be incorporated within other described methods or processes; likewise, system components described according to a particular structural configuration and/or with respect to one system may be organized in alternative structural configurations and/or incorporated within other described systems.

The present disclosure is not to be limited in terms of the particular embodiments described in this application, which are intended as illustrations of various aspects. Many modifications and variations may be made without departing from its spirit and scope. Functionally equivalent methods and apparatuses within the scope of the disclosure, in addition to those enumerated herein, are possible from the foregoing descriptions. Such modifications and variations are intended to fall within the scope of the appended claims. The present disclosure is to be limited only by the terms of the appended claims, along with the full scope of equivalents to which such claims are entitled.

Hence, while various embodiments are described with or without certain features for ease of description and to illustrate exemplary aspects of those embodiments, the various components and/or features described herein with respect to a particular embodiment may be substituted, added, and/or subtracted from among other described embodiments, unless the context dictates otherwise. Thus, unauthorized instances of apparatuses and methods claimed herein are to be considered infringing, no matter where in the world they are advertised, sold, offered for sale, used, possessed, or performed.

Consequently and in summary, although many exemplary embodiments are described above, it will be appreciated that the invention is intended to cover all modifications and equivalents within the scope of the following claims.

What is claimed is:

1. A swing set assistance kit for a swing set having an overhead beam and at least one swing seat assembly further comprising a swing seat having first and second ends, a first seat line extending from said first swing seat end to said overhead beam and a second seat line extending from said second swing seat end to said overhead beam, with said swing set assistance kit comprising a flexible cantilever member having first and second ends, a base further comprising a first stud, a transverse bar having first and second ends, a mid-section, and a second stud affixed to said mid-section, with said first end of said transverse bar attachable to said first seat line, said second end of said transverse bar attachable to said second seat line, said first stud attachable to said first end of said flexible cantilever member, and said second stud attachable to said second end of said flexible cantilever member.

2. The swing set assistance kit of claim 1, wherein said first end of said flexible cantilever member further comprises a cavity into which at least a portion of said first stud is received.

3. The swing set assistance kit of claim 1, wherein said second end of said flexible cantilever member further comprises a cavity into which at least a portion of said second stud is received.

4. The swing set assistance kit of claim 1, wherein said flexible cantilever member comprises a helical spring.

5. The swing set assistance kit of claim 1, wherein at least one end from among said first and second ends of said transverse bar comprises a threaded feature.

6. The swing set assistance kit of claim 5, further comprising a nut having threads complementary to said threaded feature.

7. The swing set assistance kit of claim 1, wherein said transverse bar is a rod of a first diameter, and at least one end from among said first and second ends of said transverse bar further comprises a head having a second diameter larger than said first diameter.

8. A swing set comprising an overhead beam and at least one swing seat assembly further comprising a swing seat having first and second ends, a first seat line extending from said first swing seat end to said overhead beam, a second seat line extending from said second swing seat end to said overhead beam, with a swing set assistance system further comprising a flexible cantilever member having first and second ends, a base further comprising a first stud, a transverse bar having first and second ends, a mid-section, and a second stud affixed to said mid-section, with said first stud being attachable to said first end of said flexible cantilever member and said second stud being attachable to said second end of said flexible cantilever member.

9. The swing set and swing set assistance system of claim 8, wherein said first end of said transverse bar is attached to said first seat line at a first intermediate point on said first seat line.

10. The swing set and swing set assistance system of claim 9, wherein said second end of said transverse bar is attached to said second seat line at a first intermediate point on said second seat line.

11. The swing set and swing set assistance system of claim 10, wherein a first distance from said overhead beam to said first intermediate point on said first line is within about 35% of a second distance from said overhead beam to said first intermediate point on said second line.

12. The swing set and swing set assistance system of claim 8, wherein said first end of said flexible cantilever member further comprises a cavity into which at least a portion of said first stud is received.

13. The swing set and swing set assistance system of claim 8, wherein said second end of said flexible cantilever member further comprises a cavity into which at least a portion of said second stud is received.

14. The swing set and swing set assistance system of claim 8, wherein said flexible cantilever member comprises a helical spring.

* * * * *